US009175402B2

(12) United States Patent
Das et al.

(10) Patent No.: US 9,175,402 B2
(45) Date of Patent: Nov. 3, 2015

(54) TURBINE REPAIR PROCESS, REPAIRED COATING, AND REPAIRED TURBINE COMPONENT

(75) Inventors: Rupak Das, Greenville, SC (US); John McConnell Delvaux, Fountain Inn, SC (US); Andres Jose Garcia-Crespo, Greenville, SC (US)

(73) Assignee: General Electric Company, Schenectady, NY (US)

( * ) Notice: Subject to any disclaimer, the term of this patent is extended or adjusted under 35 U.S.C. 154(b) by 35 days.

(21) Appl. No.: 13/561,445

(22) Filed: Jul. 30, 2012

(65) Prior Publication Data

US 2014/0030464 A1 Jan. 30, 2014

(51) Int. Cl.

| | |
|---|---|
| ***B23P 6/00*** | (2006.01) |
| ***C23C 24/08*** | (2006.01) |
| ***C23C 30/00*** | (2006.01) |

(52) U.S. Cl.

CPC ..... *C23C 24/08* (2013.01); *C23C 30/00* (2013.01); *Y10T 29/49238* (2015.01); *Y10T 428/20* (2015.01)

(58) Field of Classification Search

CPC ..... F01D 5/005; B23P 6/002; B23P 6/007
USPC ..... 29/889.1, 889, 889.21, 402.18, 458, 29/402.07; 228/119, 175, 176; 427/140, 427/202, 205; 416/232
See application file for complete search history.

(56) References Cited

U.S. PATENT DOCUMENTS

| | | | | |
|---|---|---|---|---|
| 6,283,356 | B1 * | 9/2001 | Messelling | 228/119 |
| 6,517,341 | B1 | 2/2003 | Brun et al. | |
| 6,729,872 | B2 | 5/2004 | Kobusch | |
| 7,258,530 | B2 * | 8/2007 | Morrison et al. | 416/232 |
| 8,091,227 | B2 * | 1/2012 | Hong | 29/889.1 |
| 2010/0193574 | A1 * | 8/2010 | Cretegny et al. | 228/234.1 |

OTHER PUBLICATIONS

W. Ranke, Kinetics of dissociative water adsorption on stepped Si(001), on Si(115), Si(113), Si(5,5,12) and Si(112), Surface Science 381 (1997), pp. 1-11, copyright Elsevier Science B. V. 1997.

* cited by examiner

*Primary Examiner* — Richard Chang
(74) *Attorney, Agent, or Firm* — McNees Wallace & Nurick LLC

(57) ABSTRACT

A turbine repair process, a repaired coating, and a repaired turbine component are disclosed. The turbine repair process includes providing a turbine component having a higher-pressure region and a lower-pressure region, introducing particles into the higher-pressure region, and at least partially repairing an opening between the higher-pressure region and the lower-pressure region with at least one of the particles to form a repaired turbine component. The repaired coating includes a silicon material, a ceramic matrix composite material, and a repaired region having the silicon material deposited on and surrounded by the ceramic matrix composite material. The repaired turbine component a ceramic matrix composite layer and a repaired region having silicon material deposited on and surrounded by the ceramic matrix composite material.

16 Claims, 2 Drawing Sheets

TURBINE REPAIR PROCESS, REPAIRED COATING, AND REPAIRED TURBINE COMPONENT

STATEMENT REGARDING FEDERALLY SPONSORED RESEARCH OR DEVELOPMENT

The United States Government retains license rights in this invention and the right in limited circumstances to require the patent owner to license others on reasonable terms by the terms of Government Contract No. DE-FC26-05NT42643 awarded by the United Stated Department of Energy.

FIELD OF THE INVENTION

The present invention is directed to turbine components and process of repairing turbine components. More specifically, the present invention is directed to repaired coatings on turbine components and processes of repairing coatings on turbine components.

BACKGROUND OF THE INVENTION

Gas turbine components are subjected to both thermally, mechanically, and chemically hostile environments. For example, in the compressor portion of a gas turbine, atmospheric air is compressed, for example, to 10-25 times atmospheric pressure, and adiabatically heated, for example, to between 800° F. and 1250° F. (427° C.-677° C.), in the process. This heated and compressed air is directed into a combustor, where it is mixed with fuel. The fuel is ignited, and the combustion process heats the gases to very high temperatures, for example, in excess of 3000° F. (1650° C.). These hot gases pass through the turbine, where airfoils fixed to rotating turbine disks extract energy to drive the fan and compressor of the turbine, and the exhaust system, where the gases provide sufficient energy to rotate a generator rotor to produce electricity.

Operation in these conditions may create a susceptibility to damage, for example, from foreign objects striking turbine components, such as, buckets/blades. Damage to buckets/blades can result in decreased operational efficiency of turbines, more frequent repairs, shorter duration between scheduled repairs, and/or cost inefficiencies.

An in-situ turbine repair process, a repaired coating, and a repaired turbine component that do not suffer from one or more of the above drawbacks would be desirable in the art.

BRIEF DESCRIPTION OF THE INVENTION

In an exemplary embodiment, a turbine repair process includes providing a turbine component having a higher-pressure region and a lower-pressure region, introducing particles into the higher-pressure region, and at least partially repairing an opening between the higher-pressure region and the lower-pressure region with at least one of the particles to form a repaired turbine component.

In another exemplary embodiment, a repaired coating includes a silicon dioxide material, a ceramic matrix composite material, and a repaired region having the silicon dioxide material deposited on and surrounded by the ceramic matrix composite material.

In another exemplary embodiment, a repaired turbine component a ceramic matrix composite layer and a repaired region having silicon dioxide material deposited on and surrounded by the ceramic matrix composite material.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is an exemplary turbine repair process, a repaired coating, and a repaired turbine component. Embodiments of the present disclosure extend the useful life of turbine components, permit in situ repair of coatings and/or turbine components, prevent damage due to oxidation, prevent fouling of engine hardware, or combinations thereof. One embodiment permits silicon molecules to travel through a cooling passage and stick to walls of holes made by foreign and/or domestic object damage, for example, via Brownian motion and/or thermal energy that they possess. The molecules are eventually converted to silicon dioxide and lessen recession rates of ceramic matrix composite substrates due to increased local amount of $SiO_2$ species in the vicinity of the damaged section.

Figure 1:
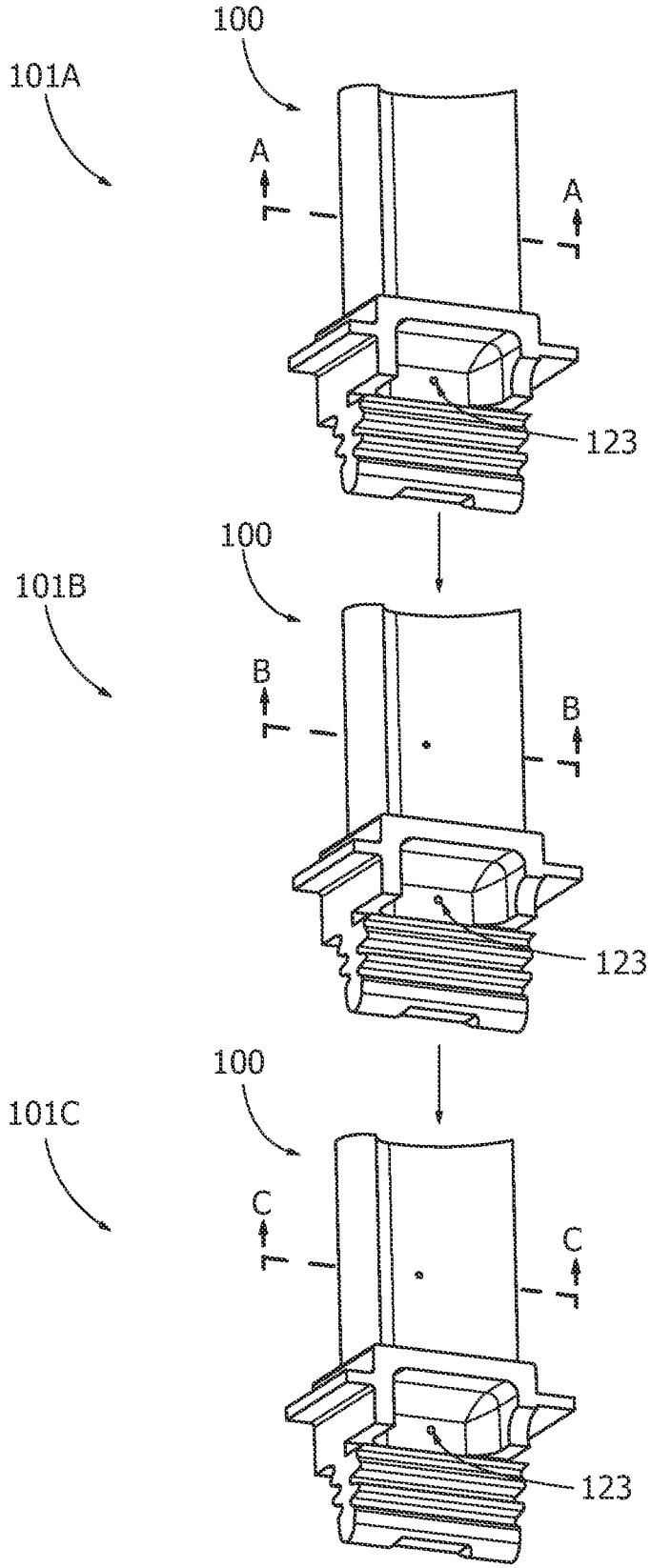
FIG. 1 schematically shows an exemplary turbine repair process of an exemplary turbine component according to the disclosure.
Figure 2:
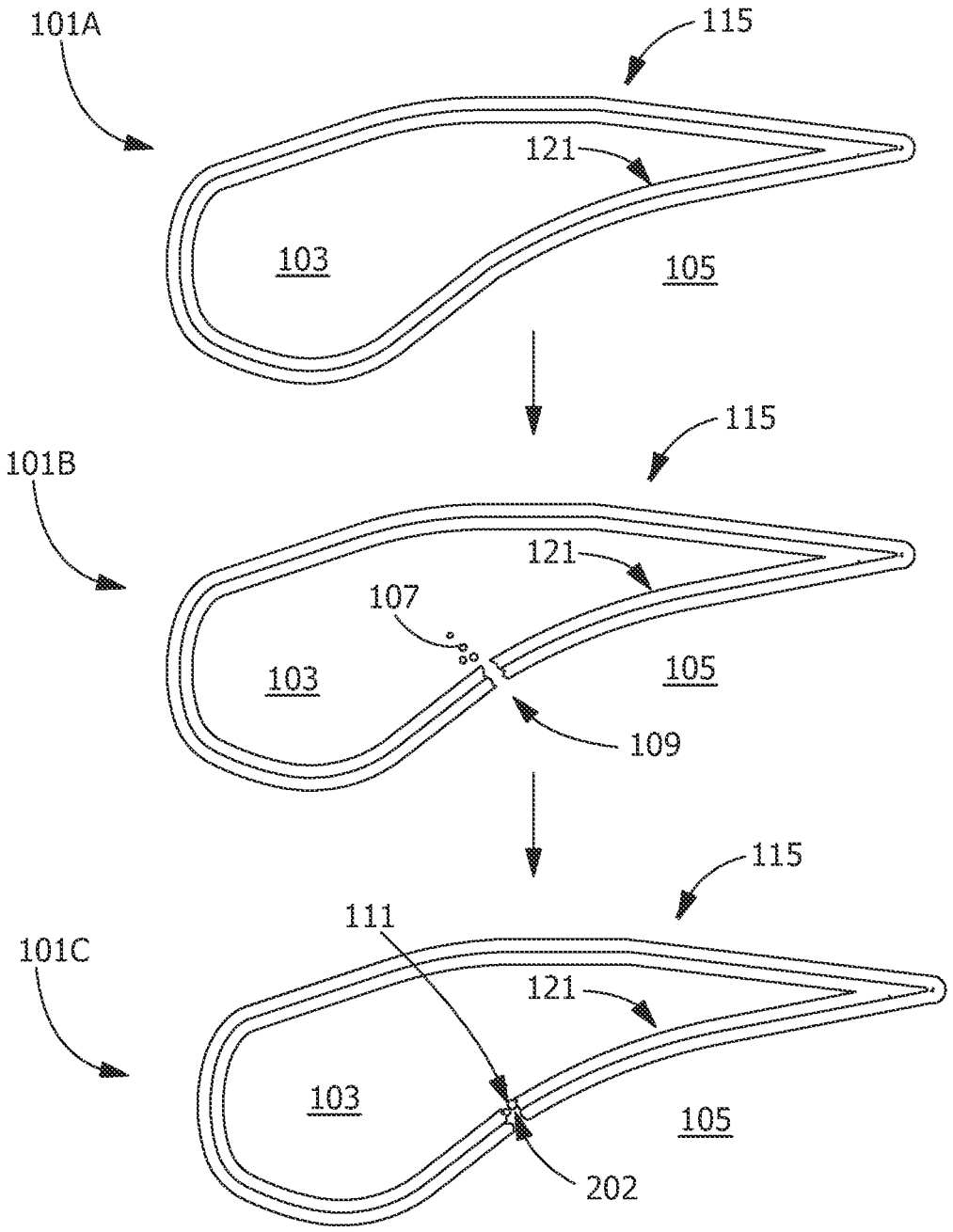
FIG. 2 schematically shows an exemplary turbine repair process of an exemplary coating according to the disclosure.

FIGS. 1 and 2 schematically show an exemplary turbine repair process. Each of FIG. 1 and FIG. 2 shows a turbine component 101A, followed by the turbine component 101B after experiencing damage, and the turbine component 101C after being repaired according to an embodiment of the process. FIG. 2 shows sectioned views corresponding with FIG. 1, along lines A-A, B-B, and C-C. The turbine repair process is capable of being used with a suitable turbine component 101. As shown in FIG. 1, in one embodiment, the turbine component is a turbine bucket 100 or blade. Other suitable turbine components include, but not limited to, a dovetail, a shank, platform, airfoil, tip cap, fir-tree, or any other suitable component having a pressure differential.

As shown in FIG. 2, the turbine component 101 includes a higher-pressure region 103 and a lower-pressure region 105. The higher-pressure region 103 of the turbine component 101 is bound by one or more layers including a ceramic matrix composite material 121. In one embodiment, the ceramic matrix composite material 121 defines a cavity within the turbine component 101, such as, a core of the turbine bucket 100. In one embodiment, the core is broken into two or more cavities.

Proximal to the lower-pressure region 105, in one embodiment, the turbine component 101 includes a coating, such as an environmental barrier coating (EBC) 115 on the turbine component 101. In one embodiment, the EBC 115 extends around the turbine component 101, such as, throughout a suction side and a pressure side. The EBC 115 includes any suitable number of layers or materials capable of operation under conditions of the lower-pressure region 105. The layer (s) of the EBC 115 is/are applied by any suitable process capable of applying material to ceramic matrix composites. For example, suitable processes include, but are not limited to, atmospheric plasma spray, reactive ion implantation, chemical vapor deposition, plasma-enhanced chemical vapor deposition, dip coating, electrophoretic deposition, or a combination thereof. Suitable layers are silicon-based and/or include silicon dioxide, such as, a bond coat providing chemical compatibility with ceramic matrix composites. Another suitable layer is a transition layer, such as, barium strontium aluminosilicate (BSAS), $(Yb,Y)_2Si_2O_7$, mullite with barium strontium aluminosilicate, or a combination thereof, providing resistance to water-vapor penetration, chemical compatibility with the bond coat, a coefficient of thermal expansion compatible with ceramic matrix composites, or a combination thereof. Another suitable layer is a top coat, such as, $Y_2SiO_5$ or barium strontium aluminosilicate, providing water-vapor recession and/or a coefficient of thermal expansion compatible with ceramic matrix composites. In further embodiments, the EBC 115 includes a thermally grown oxide layer.

During operation of a turbine using the turbine component 101, the higher-pressure region 103 and the lower-pressure region 105 are under different conditions. For example, during operation, the higher-pressure region 103 is at a higher pressure than the lower-pressure region 105, resulting in the pressure differential. The pressure differential decreases upon a portion of the EBC 115 and the ceramic matrix composite material 121 being removed, for example, by foreign object damage to the lower-pressure region 105. Such damage forms an opening 109 between the higher-pressure region 105 and the lower-pressure region 103.

In one embodiment, prior to the foreign object damage, the turbine component 101A operates with a predetermined pressure differential range, for example, between about 3% and 10% more than an outside zone (such as, a hot gas path) and/or greater than about 3 psi, greater than about 5 psi, at about 5 psi, between about 3 psi and about 7 psi, between about 5 psi and about 7 psi, or any suitable combination, sub-combination, range, or sub-range thereof. Upon foreign object damage occurring or after foreign object damage has occurred, the pressure differential between the higher-pressure region 103 and the lower-pressure region 105 of the turbine component 101B decreases. In one embodiment, the decreased pressure differential is identified, thereby permitting identification of the damage without visual inspection. In response to the foreign object damage occurring, the turbine repair process is employed.

Additionally or alternatively, such identification of foreign object damage is capable of being based upon monitoring of a predetermined pressure range for the higher-pressure region 103 and/or a predetermined pressure range for the lower-pressure region 105. In one embodiment, the predetermined pressure range for the higher-pressure region 103 is between about 3% and 10% more than an outside zone (such as, a hot gas path and/or the lower-pressure region 105). After foreign object damage, the pressure within the higher-pressure region 103 is decreased.

The higher-pressure region 103 and the lower-pressure region 105 also operate under temperature differences, providing a temperature differential. For example, in one embodiment, the higher-pressure region 103 operates at a lower temperature, such as, between about 700° F. and about 1500° F., and the lower-pressure region 105 operates at a higher temperature, such as, between 1200° F. and about 2500° F.

The opening 109 may be formed by the foreign object damage between the higher-pressure region 103 and the lower-pressure region 105, resulting in the decrease in the pressure differential between the higher-pressure region 103 and the lower-pressure region 105. The foreign object has a random size based upon structured particles and/or agglomerates coming from upstream portions. In one embodiment, the foreign object damage corresponds to a foreign particle having a dimension of greater than about 1.4 mm, greater than about 1.6 mm, greater than about 1.8 mm, greater than about 2.0 mm, greater than about 2.2 mm, or any suitable combination, sub-combination, range, or sub-range thereof. The opening 109 has a void geometry formed through the EBC 115 and the ceramic matrix composite material 121. For example, in one embodiment, the opening 109 is a channel, a cylindrical recess or hole, a conical recess or hole, a frusto-conical recess or hole, a crack/fissure, or any combination thereof.

To repair the damage, the opening 109 is at least partially repaired by one or more of the particles 107 that are introduced through the higher-pressure region 103. In one embodiment, the particles 107 are introduced through a feed 123, for example, positioned in a dovetail portion of the turbine bucket 100. The particles 107 travel toward the opening 109, for example, based upon the pressure differential, contacting the ceramic matrix composite material 121. A portion of the particles 107 contacts the EBC 115 and/or is expelled into the lower-pressure region 105. The particles 107 that contact the EBC 115 do not substantially adhere. At least a portion of the particles 107 that contact the ceramic matrix composite material 121 adhere. These particles 107 disrupt the opening 109, thereby at least partially filling the whole affected passage and permitting the pressure differential to increase, for example, such that the higher-pressure region 103 and the lower-pressure region 105 differ in pressure within the operational range present prior to the foreign object damage and at least partially repairing the turbine component 101C. In one embodiment, the particles 107 are converted to other materials, such as a fused ceramic and/or an oxidized material (for example, silicon dioxide), through the presence of heat and/or oxygen.

The particles 107 are any suitable particles capable of being introduced to the higher-pressure region 103 and at least partially repairing the opening 109. In one embodiment, the particles 107 include elemental silicon. In a further embodiment, the oxygen and/or moisture of the higher-pressure region 103 converts a portion or substantially all of the particles 107 into silicon dioxide.

The particles 107 are any suitable geometry and size permitting introduction into the higher-pressure region 103 and at least partially repairing of the opening 109. In one embodiment, one or more of the particles 107 are spheroid, spherical, cuboid, substantially planar, complex-shaped, or a combination thereof. In one embodiment, one or more of the particles 107 are nano-sized, for example, having a maximum dimension within a nanometer range, such as, between about 2 nm and about 10 nm, between about 5 nm and about 6 nm, less than about 20 nm, less than about 10 nm, less than about 5 nm, or any suitable combination, sub-combination, range, or sub-range thereof. In one embodiment, one or more of the particles 107 are micron-sized, for example, having a maximum dimension within a micron range, such as, less than about 2 microns, less than about 1 micron, between about 1 micron and about 2 microns, about 1 micron, or any suitable combination, sub-combination, range, or sub-range thereof.

The particles 107 are introduced in any suitable manner, for example, capable of permitting continued, non-stop operation of a turbine utilizing the turbine component 101. In one embodiment, the particles 107 are suspended in a fluid, such as a liquid and/or a gas. In one embodiment, the particles 107 are introduced by injection, for example, with air and/or other gases, into the feed 123.

In one embodiment, the particles 107 are introduced with air. In one embodiment, the particles 107 are introduced with the air at a weight ppm Si of between about 0.07 and about 4, between about 0.07 and about 0.2, between about 1 and about 2, between about 2 and about 3, between about 3 and about 4, or any suitable combination, sub-combination, range, or sub-range thereof.

In one embodiment, the particles 107 are introduced intermittently, for example, to form about 1 thousand's of an inch of material in the opening 109 per day, at a rate of about 4 mols, or any other suitable rate permitting the turbine component 101 to be repaired. In one embodiment, the particles 107 are introduced during operation of a turbine utilizing the turbine component.

Upon being repaired, the turbine component 101, such as the bucket 100, includes a repaired region 111 of the repaired coating having a silicon dioxide material 202 deposited on and surrounded by the ceramic matrix composite material 121, corresponding to a region of damage from the foreign object damage, such as the opening 109. In one embodiment, the silicon dioxide material 202 is deposited on and completely encircled by a portion of the ceramic matrix composite material 121 and/or the EBC 115. In one embodiment, the silicon dioxide material 202 includes entrained elemental silicon that has not oxidized. In this embodiment, the repaired region 111 has a hardness between the hardness of silicon dioxide and silicon.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine repair process, comprising:

providing a damaged turbine component comprising a substrate of ceramic matrix composite, the component having a higher-pressure region at least partially within a hollow portion of the damaged turbine component and a lower-pressure region, the higher-pressure region being at a higher pressure than the lower-pressure region, wherein the damaged turbine component includes an opening between the higher-pressure region and the lower-pressure region;

introducing particles suspended in a fluid into the higher-pressure region, wherein the particles travel toward the opening; and at least partially repairing the opening with at least one of the particles to form a repaired turbine component.

2. The process of claim 1, further comprising identifying a pressure difference between the higher-pressure region and the lower-pressure region prior to introducing the particles into the higher-pressure region.

3. The process of claim 1, wherein the higher pressure of the higher-pressure region is about 3% greater than a lower pressure of the lower-pressure region.

4. The process of claim 1, wherein the higher pressure of the higher-pressure region is about 10% greater than a lower pressure of the lower-pressure region.

5. The process of claim 1, wherein the higher pressure of the higher-pressure region is between about 3% and about 10% greater than a lower pressure of the lower-pressure region.

6. The process of claim 1, wherein the particles include elemental silicon.

7. The process of claim 1, wherein the lower-pressure region is at a temperature of between about 1200° F.' and about 2500° F.

8. The process of claim 1, wherein the higher-pressure region is at a temperature of between about 700° F. and about 1500° F.

9. The process of claim 1, wherein the particles are less than about 20 nm.

10. The process of claim 1, wherein the particles are less than about 2 microns.

11. The process of claim 1, wherein the introducing of the particles is by injection with compressed air.

12. The process of claim 1, wherein the higher-pressure region is defined by a layer including ceramic matrix composite material.

13. The process of claim 1, wherein the repaired turbine component is a turbine bucket, a shroud, or a nozzle.

14. The process of claim 1, wherein the repaired turbine component includes a repaired region having a silicon material deposited on and surrounded by a ceramic matrix composite material.

15. The process of claim 1, wherein at least a portion of the particles are oxides after the at least partially repairing of the opening.

16. The process of claim 1, wherein at least a portion of the particles are fused after the at least partially repairing of the opening.

* * * * *